United States Patent [19]

Hollingshad

[11] 3,941,562

[45] Mar. 2, 1976

[54] CORROSION INHIBITION

[75] Inventor: William Robert Hollingshad, Bethel Park, Pa.

[73] Assignee: Calgon Corporation, Pittsburgh, Pa.

[22] Filed: June 4, 1973

[21] Appl. No.: 367,081

[52] U.S. Cl. ..... 21/2.7 R; 21/2.5 A; 21/2.5 R; 21/2.7 A; 252/180; 252/181; 252/387; 252/389 A

[51] Int. Cl.[2] ..... C23F 11/16; C23F 11/10

[58] Field of Search ..... 252/389 A, 389 R, 387, 252/180, 181, 390; 21/2.5 A, 2.5 R, 2.7 A, 2.7 R; 210/58, 59

[56] References Cited

UNITED STATES PATENTS

| | | | |
|---|---|---|---|
| 3,505,238 | 4/1970 | Liddell | 252/390 |
| 3,510,436 | 5/1970 | Silverstein et al. | 252/389 A |
| 3,578,589 | 5/1971 | Hwa et al. | 21/2.7 A |
| 3,679,587 | 7/1972 | Smith | 252/389 A |
| 3,816,333 | 6/1974 | King et al. | 252/389 A |

*Primary Examiner*—Leland A. Sebastian
*Assistant Examiner*—Irwin Gluck
*Attorney, Agent, or Firm*—Rudolph J. Anderson, Jr.; Harry E. Westlake; Martin L. Katz

[57] ABSTRACT

Use of low molecular weight polymer and phosphate compositions to inhibit the corrosion of metals by oxygen-bearing waters.

5 Claims, No Drawings

CORROSION INHIBITION

BACKGROUND OF THE INVENTION

This invention relates to the inhibition of corrosion in water systems which utilize oxygen-bearing waters.

More particularly, this invention relates to the use of compositions comprising low molecular weight polymers and phosphates to inhibit the corrosion of metals in water systems which contain oxygen-bearing waters.

Oxygen corrosion is, of course, a serious problem in any metal-containing water system. The corrosion of iron and steel is of principal concern because of their extensive use in many types of water systems. Copper and its alloys, aluminum and its alloys, and galvanized steel are also used in water systems and are subject to corrosion. I have discovered corrosion inhibitors which will inhibit oxygen corrosion in water systems containing such metals.

SUMMARY OF THE INVENTION

I have found that compositions comprising low molecular weight polymers and phosphates are effective corrosion inhibitors. Suitable polymers include water-soluble salts of acrylates and methacrylates, unhydrolyzed or partially hydrolyzed acrylamides, and acrylamidomethyl propane sulfonates. The polymers may be homo-, co-, or ter- polymers of any of the aforementioned polymers and may have a molecular weight of from about 500 to about 10,000. The preferred molecular weight, however, is about 1,000.

Suitable phosphates include any source of the ortho-$PO_4^{-3}$ ion as, for example, phosphoric acid, mono, di and tri sodium phosphate, or mono, di and tri sodium polyphosphate.

The corrosion-inhibiting compositions can contain a ratio of polymer to phosphate of from about 20:1 to about 1:1 by weight. The preferred ratio, however, is from about 5:1 to 2:1 by weight. These compositions will effectively inhibit corrosion of metals when maintained in a water system at a concentration of at least about 10 ppm at the above ratios and, preferably, about 30 ppm. Maximum concentrations are determined by the economic considerations of the particular application.

It may, of course, be desirable to add zinc to the compositions of this invention for certain applications. The zinc ion may be supplied in many ways. For example, it may be added by utilizing a water-soluble zinc salt, such as, zinc chloride, zinc acetate, zinc nitrate, or zinc sulfate or it may be supplied by adding powdered zinc to a solution of the composition.

Compounds such as benzotriazole or mercaptobenzothiazole may also be added to the final formulation in varying amounts to improve its usefulness in a wider variety of industrial applications where both steel and copper are present in the same system.

The following tables show the results of experiments which demonstrate the effectiveness of the compositions of this invention in inhibiting metallic corrosion. These tests were run in synthetic Pittsburgh water. Steel electrodes were used in polarization test cells with the initial pH at 7.0. Inhibitor concentrations were calculated on the basis of 100 percent active material. The amount of corrosion that had taken place was determined from the current density at the intersection of an extrapolation of the so-called "Tafel" portion of the anodic polarization curve with the equilibrium or "mixed" potential value, usually referred to as the corrosion potential, "$E_{corr}$." Application of Faraday's Law allows a computation of a direct mathematical relationship between the current density at $E_{corr}$, expressed in amperes per square centimeter and a more useful corrosion rate expression such as milligrams of steel consumed per square decimeter of surface per day (*m.d.d.*) and mils per year (*m.p.y.*). This relationship is such that a current density value of $4.0 \times 10^{-7}$ amperes/cm$^2$ = 1.0 mg/dm$^2$/day. Further, the *m.p.y.* value is calculated from the formula: *m.p.y.* = *m.d.d.* × (1.44/density), using a density value of 7.87 g/cm$^3$ for steel.

The following tables illustrate the synergistic effect of a composition comprising sodium polyacrylate and phosphoric acid as a corrosion inhibitor in tests run at 35°C.

Table 1

| Inhibitor System | Dosage (mg/l) | Corrosion Rate (mdd) |
|---|---|---|
| Control | 0 | 100 |
| Sodium Polyacrylate (molecular weight ~ 1,000) | 30 | 78 |
| Phosphoric Acid | 5 | 83 |
| Sodium Polyacrylate + Phosphoric Acid | 30 + 5 | 4 |

Table 2

| Inhibitor System | Dosage (mg/l) | Corrosion Rate (mdd) |
|---|---|---|
| Control | 0 | 100 |
| Sodium Polyacrylate (molecular weight ~ 1,000) | 60 | 48 |
| Phosphoric Acid | 3 | 73 |
| Sodium Polyacrylate + Phosphoric Acid | 60 + 3 | 10 |

Table 3

| Inhibitor System | Dosage (mg/l) | Corrosion Rate (mdd) |
|---|---|---|
| Control | 0 | 100 |
| Sodium Polyacrylate (molecular weight ~ 1,000) | 60 | 48 |
| Phosphoric Acid | 9 | 8 |
| Sodium Polyacrylate + Phosphoric Acid | 60 + 9 | 2 |

I claim:

1. A method of inhibiting the corrosion of metals in a water system which comprises maintaining in the water of said system at least about 10 ppm of a composition comprising a polyacrylamide having a molecular weight of from about 500 to about 10,000 and a source of orthophosphate.

2. A method as in claim 1 wherein the ratio of polymer to phosphate is from about 20:1 to about 1:1 by weight.

3. A method as in claim 2 wherein the ratio of polymer to phosphate is from about 5:1 to about 2:1 by weight.

4. A method as in claim 1 which further contains zinc.

5. A method as in claim 1 which further comprises a member selected from the group consisting of benzotriazole and mercaptobenzothiazole.

* * * * *